United States Patent [19]

Aoki

[11] Patent Number: 4,779,314

[45] Date of Patent: Oct. 25, 1988

[54] MAGNETIC FASTENER

[75] Inventor: Yoshihiro Aoki, Tokyo, Japan

[73] Assignee: Application Art Laboratories Co., Ltd., Tokyo, Japan

[21] Appl. No.: 68,336

[22] Filed: Jul. 1, 1987

[30] Foreign Application Priority Data

Jul. 24, 1986 [JP] Japan ..... 61-174376

[51] Int. Cl.[4] ..... A44B 21/00

[52] U.S. Cl. ..... 24/303; 335/285

[58] Field of Search ..... 335/285, 286, 302; 24/303; 292/251.5; 248/206.5; 211/DIG. 1

[56] References Cited

U.S. PATENT DOCUMENTS

| | | | |
|---|---|---|---|
| 1,198,227 | 9/1916 | Hinchey | 211/DIG. 1 |
| 2,637,887 | 5/1953 | Goodman et al. | 24/251.5 |
| 2,901,278 | 8/1959 | Robinson | 292/251.5 |
| 3,041,697 | 7/1962 | Budreck | 24/303 |
| 3,141,216 | 7/1964 | Brett | 24/303 |
| 4,021,891 | 5/1977 | Morita | 24/303 |
| B1 4,021,891 | 8/1986 | Morita | 24/303 |

FOREIGN PATENT DOCUMENTS

| | | | |
|---|---|---|---|
| 1068149 | 10/1959 | Fed. Rep. of Germany | 24/303 |
| 1127509 | 4/1962 | Fed. Rep. of Germany | 335/285 |
| 44-27953 | 11/1969 | Japan | 24/303 |
| 47-16817 | 11/1972 | Japan | 24/303 |
| 59-119804 | 7/1984 | Japan | 335/285 |
| 60-210805 | 10/1985 | Japan | 335/285 |

*Primary Examiner*—George Harris

*Attorney, Agent, or Firm*—Wenderoth, Lind and Ponack

[57] ABSTRACT

A magnetic fastener which substantially excludes external leakage of magnetic flux therefrom. The magnetic fastener has a fixed element and a movable element. The fixed element includes a permanent magnet plate, upper and lower iron plates located on upper and lower faces of the permanent magnet plate, and an iron bar erected uprightly on the lower iron plate. The upper iron plate has an upper face flush with an upper end face of the iron bar to form a magnetic attracting face. The fixed element further includes a magnetic shield plate located above the upper iron plate around the magnetic attracting face with a magnetic gap interposed therebetween. The magnetic shield plate has a cylindrical portion which covers outer peripheries of the upper iron plate and the permanent magnet plate and contacts with an outer peripheral edge of the lower iron plate.

8 Claims, 4 Drawing Sheets

MAGNETIC FASTENER

BACKGROUND OF THE INVENTION

1. Field of the Invention

This invention relates to a magnetic fastener for use with a handbag or a like article in the form of a bag or with clothing.

2. Prior Art

Conventionally, a fastener which makes use of a permanent magnet is used as a device for fastening a cover piece to a main body of a bag such as a handbag or a brief case or used as a fastening device in place of a button of clothing.

Various magnetic fasteners of different structures have been proposed and put into practical use so far, and one of such known magnetic fasteners includes a fixed element including a permanent magnet, a pair of ferromagnetic plates attached to opposite faces adjacent the magnetic poles of the permanent magnet, and a ferromagnetic bar implanted on one of the ferromagnetic plates and having an opposite end face flush with a surface of the other ferromagnetic plate to form a magnetic attracting face, and a movable element including a ferromagnetic member for being removably attracted to the magnetic attracting face (for example, Japanese utility laid-open Nos. 56-65070 and 56-149416).

Since the magnetic fastener as described has a structure in which magnetic flux from the north and south poles of the permanent magnet are introduced to the magnetic attracting face by way of the ferromagnetic plates and the ferromagnetic bar, equivalently the north and south poles of the permanent magnet are located adjacent the magnetic attracting force. Accordingly, the magnetic fastener has a characteristic that, even before the movable element is attracted to the magnetic attracting face of the fixed element, little magnetic flux is emitted externally of the magnetic fastener.

However, it is very difficult to completely exclude external leakage of magnetic flux from the magnetic fastener. In fact, although such a magnetic fastener has a cover located a little above and around the magnetic attracting face in order to prevent the magnetic attracting face from being directly contacted by any other article, some leakage flux remains even outside the cover.

SUMMARY OF THE INVENTION

It is an object of the present invention to provide a magnetic fastener which substantially excludes external leakage of magnetic flux therefrom.

In order to attain this object, according to the present invention, there is provided a magnetic fastener, comprising a fixed element including a permanent magnet plate magnetized so as to present the magnetic poles adjacent upper and lower faces thereof, a pair of ferromagnetic plates located adjacent the upper and lower faces of said permanent magnet plate, and a ferromagnetic bar erected uprightly on that one of said ferromagnetic plates which is located adjacent the lower face of said permanent magnet plate, the other ferromagnetic plate adjacent the upper face of said permanent magnetic plate having an upper face flush with an upper end face of said ferromagnetic bar to form a magnetic attracting face, and a movable element including a ferromagnetic member for being removably attracted to said magnetic attracting face, said fixed element further including a magnetic shield plate located above a portion of the upper face of said the other ferromagnetic plate around said magnetic attracting face with a magnetic gap interposed therebetween, said magnetic shield plate having a cylindrical portion extending from an outer edge thereof, said cylindrical portion of said magnetic shield plate covering the outer peripheries of said the other ferromagnetic plate and said permanent magnet plate and contacting an outer peripheral edge of the one ferromagnetic plate adjacent the lower face of said permanent magnet plate.

According to the magnetic fastener of the invention, external leakage of magnetic flux from the magnetic fastener can be minimized due to the presence of the magnetic shield plate.

The above and other objects, features and advantages of the present invention will become apparent from the following description and the appended claims, taken in conjunction with the accompanying drawings.

BRIEF DESCRIPTION OF THE DRAWINGS

FIG. 5 is a view similar to FIG. 1 showing a fourth embodiment of the invention.

DETAILED DESCRIPTION OF THE PREFERRED EMBODIMENTS

Figure 1:
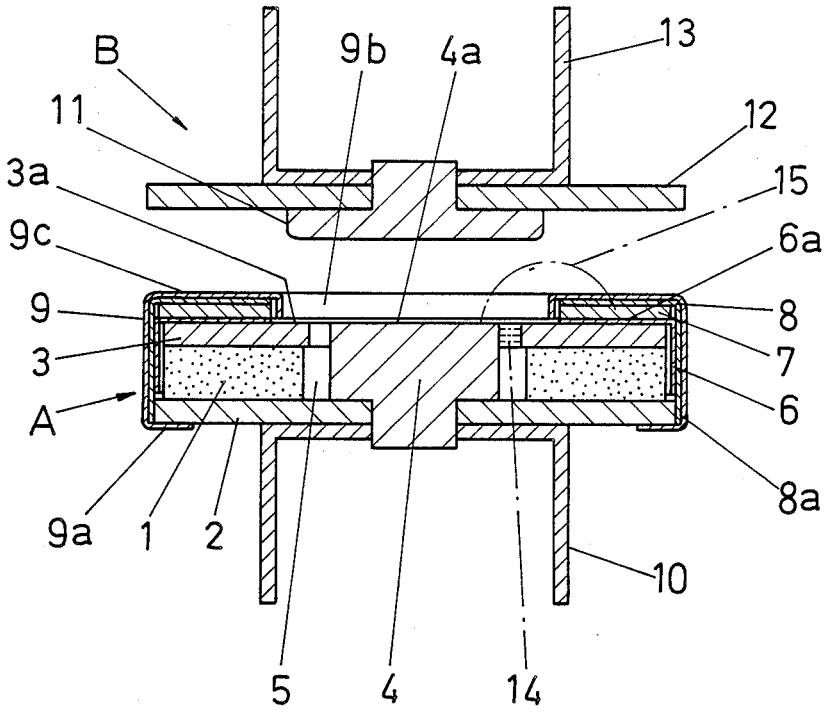
FIG. 1 is a cross sectional view of a magnetic fastener illustrating a preferred embodiment of the present invention.
Figure 2:
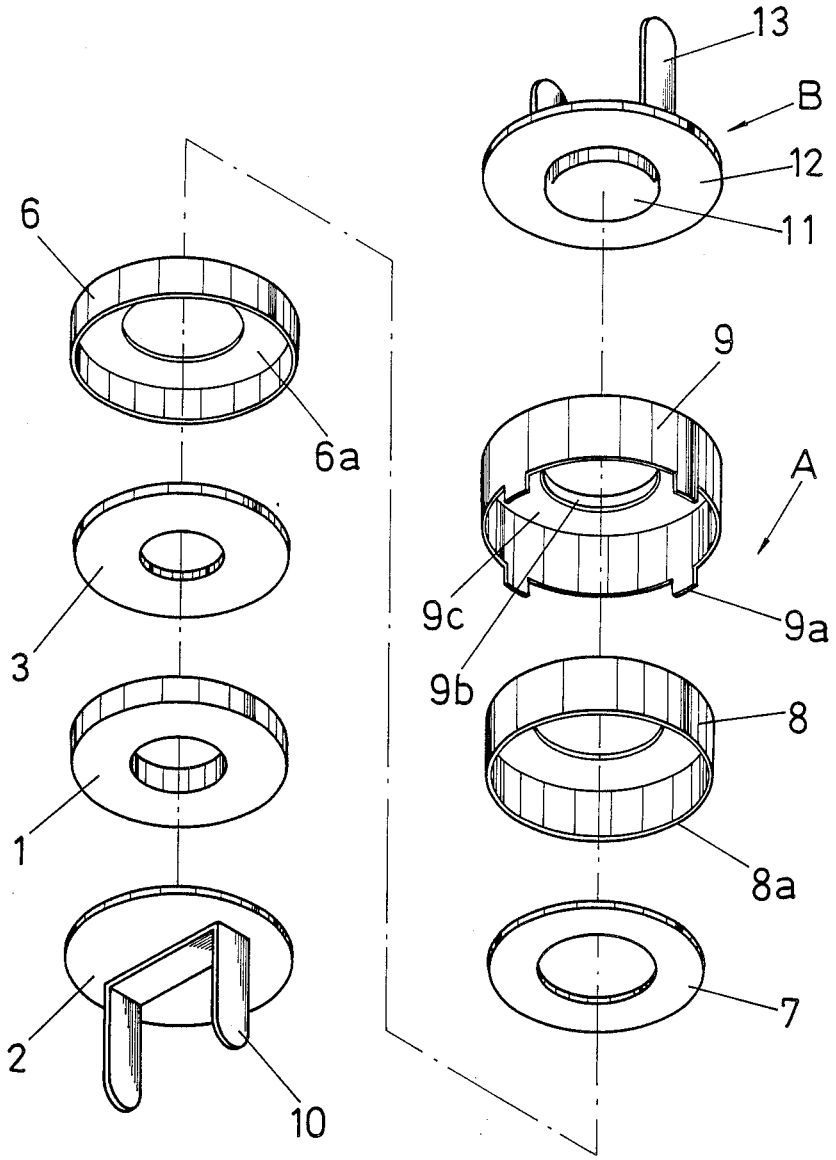
FIG. 2 is an exploded perspective view of the magnetic fastener of FIG. 1.

Referring first to FIGS. 1 and 2, there is shown a magnetic fastener according to the present invention. The magnetic fastener shown includes a fixed element A and a movable element B. The fixed element A includes a permanent magnet plate 1 in the form of an annular ring, an iron plate 2 in the form of a disk located on a bottom face (adjacent the north or south pole) of the permanent magnet plate 1, another iron plate 3 in the form of an annular ring located on a top face (adjacent the south or north pole) of the permanent magnet plate 1, and an iron bar 4 erected uprightly at the central portion of the iron plate 2 and extending through the center hole 5 formed in the permanent magnet plate 1 toward the iron plate 3 until the upper end face 4*a* thereof comes flush with the upper face 3*a* of the iron plate 3 thereby to form a magnetic attracting face at a central portion of the iron plate 3 around the iron bar 4. An annular portion of the iron plate 3 outside the magnetic attracting face is covered with an annular spacer 6 made of brass and having an inverted L-shaped cross section. An annular magnetic shield plate 8 having an inverted L-shaped cross section similar to the annular spacer 6 is located above the top wall 6*a* of the annular spacer 6 with a magnetic gap interposed therebetween. Here, the magnetic gap is formed by a brass plate 7 in the form of an annular ring. A cylindrical portion of the magnetic shield plate 8 covers entire outer circumferential faces of the iron plate 3 and the permanent magnet plate 1 and has the lower end 8*a* contacted with the outer circumferential edge of and magnetically connected to the iron plate 2.

The individual members described above are covered and integrally joined together by an annular cover 9 made of brass and having four fingers 9*a* formed thereon which are bent to engage against portions of the lower face of the iron plate 2. A channel-shaped mounting leg member 10 is secured to a central portion of the lower face of the iron plate 2. The mounting leg member 10 is secured to the iron plate 2 by caulking the base end portion of the iron bar 4 to the iron plate 2 and the mounting leg member 10.

The movable element B includes a core metal member 11 made of iron and having a diameter substantially equal to or more accurately a little smaller than that of the inner cylindrical portion 9*b* of the cover 9 so that it can be removably attracted to and contacted with the magnetic attracting face of the fixed element A described above. The movable element B further includes a disk 12 placed on the core metal member 11, and a mounting leg member 13 joined together to the core metal member 11 and the disk 12 by caulking the core metal member 11 to the mounting leg member 13 and the disk 12. It is to be noted that the disk 12 is shown as having an outer diameter substantially equal to that of the cover 9, although the diameters of the two members need not necessarily be equal to each other, and besides the disk 12 may be made of a magnetic material or a non-magnetic material. The thickness of the core metal member 11 is selected such that when the disk 12 is contacted with the top wall 9*c* of the cover 9, the bottom face of the core metal member 11 will just be contacted with the magnetic attracting face of the fixed element A.

In the magnetic fastener having the construction described above, if the bottom face of the magnetic core member 11 of the movable element B is contacted with the magnetic attracting face of the fixed element A, then a magnetic path without an air gap is completed by the iron plates 2, 3, the iron bar 4 and the core metal member 11 so that the movable element B is attracted strongly to the fixed element A. On the contrary, if the movable element B is pulled apart from the fixed element A by overcoming the attracting force therebetween, most of magnetic flux of the permanent magnet plate 1 will appear, in a general case, between an upper portion of the side wall of the iron bar 4 and an opposing portion of the inner circumferential wall of the iron plate 3 as indicated by chain lines 14 in FIG. 1 but some part of the magnetic flux may appear between the upper surface of the iron plate 3 and the top end face of the iron bar 4 as indicated by a chain line 15 in FIG. 1. However, the magnetic shield plate 8 shields this last mentioned part of magnetic flux which may otherwise appear outside the fixed element A as indicated by the chain line 15 in FIG. 1. In particular, magnetic flux emitted from the iron plate 3 will be introduced to the iron plate 2 by way of the magnetic shield plate 8 which has the same magnetic polarity as the iron plate 2. Accordingly, such magnetic flux which may appear outside the fixed member A as indicated by the chain line in FIG. 1 can be minimized.

Actual measurement has shown that the intensity of magnetic field at a location just above the top wall 9*c* of the cover 9 was about 800 gauss in the case of a conventional magnetic fastener having no such magnetic shield as the magnetic shield 8 but was reduced to about 100 gauss in the case of the magnetic fastener of the present embodiment.

Also in the case of a modified magnetic fastener in which the brass plate 7 of the magnetic fastener of the embodiment is replaced by an air gap 16 as illustrated in FIG. 5, the intensity of magnetic field is also about 100 gauss.

Figure 3:
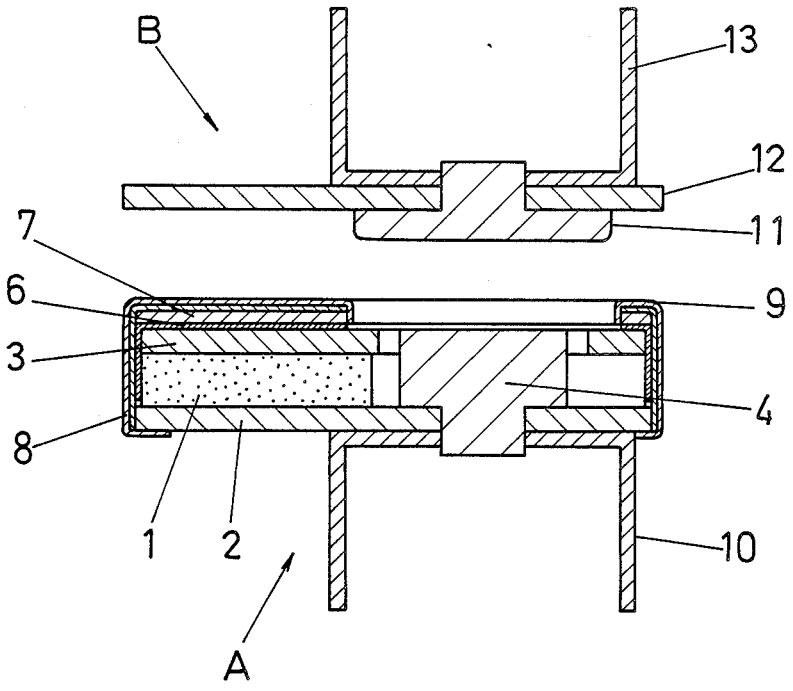
FIG. 3 is a cross sectional view of another magnetic fastener illustrating a second embodiment of the invention.

It is to be noted that while in the embodiment described above the iron bar 4 is erected uprightly at a central portion of the iron plate 2, a similar function will be obtained if it is erected uprightly otherwise at a side or an eccentric portion of the iron plate 2 as shown in FIG. 3 so as to form the magnetic attracting face at an eccentric location of the fixed element A. Further, while the individual elements of the fixed and movable elements A and B of the magnetic fastener of the embodiment except the mounting leg members 10 and 13 are each in the form of a disk or an annular ring and accordingly the magnetic fastener has a circular profile, it is also possible to produce a magnetic fastener of a rectangular, polygonal or elliptical profile using rectangular, polygonal or elliptical components.

Figure 4:
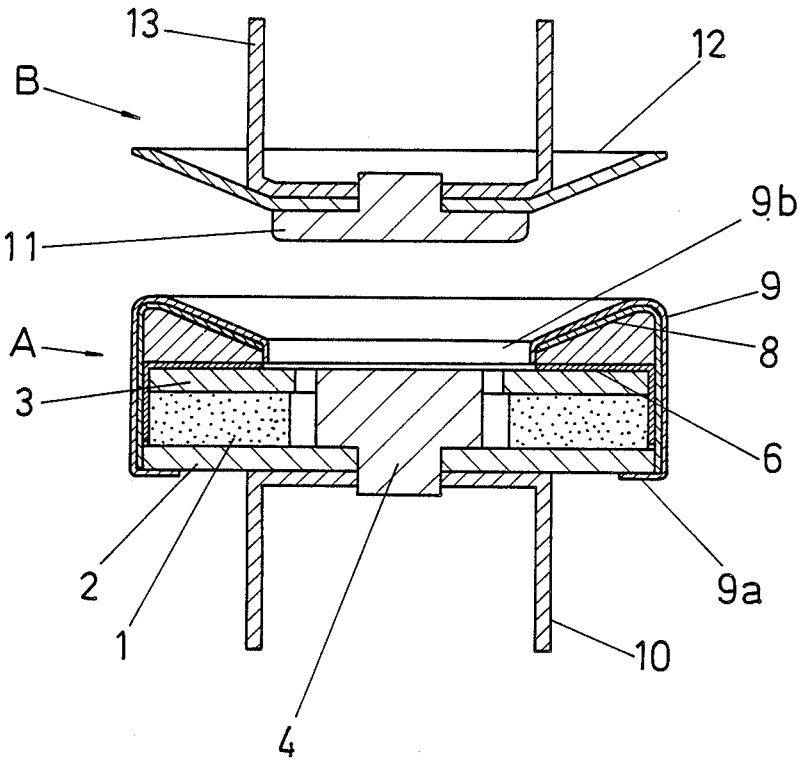
FIG. 4 is a cross sectional view of a further magnetic fastener illustrating a third embodiment of the invention.

Further, the top wall of the cover 9 of the fixed element A and an opposing portion of the disk 12 of the movable element B may each be modified into a funnel shape as shown in FIG. 4 so that the magnetic attracting face may be located at a deeper position with respect to the top of the fixed element. With the construction shown in FIG. 4, an article which dislikes magnetism cannot approach the magnetic attracting face of the fixed element A nearer than the depth of the inner cylindrical portion 9*b* of the cover 9.

As is apparent from the foregoing description, according to the present invention, external leakage of magnetic flux from a fixed element when a movable element is pulled away from the fixed element can be minimized. Accordingly, the magnetic fastener of the invention has an effect that the safety thereof with respect to an article such as a magnetic card which is apt to be easily damaged by magnetism can be improved.

Having now fully described the invention, it will be apparent to one of ordinary skill in the art that may changes and modifications can be made thereto without departing from the spirit and scope of the invention as set forth herein.

What is claimed is:

1. A magnetic fastener, comprising a fixed element including a permanent magnet plate magnetized so as to present the magnetic poles adjacent upper and lower faces thereof, a pair of ferromagnetic plates located adjacent the upper and lower faces of said permanent magnet plate, and a ferromagnetic bar erected uprightly on that one of said ferromagnetic plates which is located adjacent the lower face of said permanent magnet plate, the other ferromagnetic plate adjacent the upper face of said permanent magnetic plate having an upper face flush with an upper end face of said ferromagnetic bar to form a magnetic attracting face, and a movable element including a ferromagnetic member for being removably attracted to said magnetic attracting face, said fixed element further including a magnetic shield plate located above a portion of the upper face of said the other ferromagnetic plate around said magnetic attracting face with a magnetic gap between said magnetic shield and said upper face, said magnetic shield plate having a cylindrical portion extending from an outer edge thereof, said cylindrical portion of said magnetic shield plate covering the outer peripheries of said other ferromagnetic plate and said permanent magnet plate and contacting an outer peripheral edge of the one ferromagnetic plate adjacent the lower face of said permanent magnet plate.

2. A magnetic fastener according to claim 1, wherein said magnetic gap is constituted by a member of a non-magnetic material.

3. A magnetic fastener according to claim 1, further comprising a spacer interposed between said the other ferromagnetic plate and said permanent magnet plate within said cylindrical portion of said magnetic shield plate.

4. A magnetic fastener according to claim 1, wherein said ferromagnetic bar is erected uprightly at a central portion of said one ferromagnetic plate.

5. A magnetic fastener according to claim 1, further comprising a cover covering the portion of said other ferromagnetic plate around said magnetic attracting face.

6. A magnetic fastener according to claim 5, wherein a portion of said cover which contacts said movable element has a funnel-like shape.

7. A magnetic fastener as claimed in claim 2, wherein said magnetic gap is constituted by an air gap.

8. A magnetic fastener as claimed in claim 4, wherein said ferromagnetic bar is erected uprightly at a side portion of said one ferromagnetic plate.

* * * * *